US008342609B2

(12) United States Patent
Holdcroft et al.

(10) Patent No.: US 8,342,609 B2
(45) Date of Patent: Jan. 1, 2013

(54) MINING METHOD

(75) Inventors: Robert James Holdcroft, Johannesburg (ZA); Neville Robert Marillier, Germiston (ZA); Derek Luke Anthony, Edenvale (ZA); Andre Pienaar, Pretoria (ZA)

(73) Assignee: AEL Mining Services Limited, Woodmead (ZA)

( * ) Notice: Subject to any disclaimer, the term of this patent is extended or adjusted under 35 U.S.C. 154(b) by 161 days.

(21) Appl. No.: 12/660,812

(22) Filed: Mar. 4, 2010

(65) Prior Publication Data

US 2011/0006585 A1 Jan. 13, 2011

(30) Foreign Application Priority Data

Mar. 6, 2009 (ZA) ..... 2009/01636

(51) Int. Cl.
*E21C 37/00* (2006.01)

(52) U.S. Cl. ..... 299/13

(58) Field of Classification Search ..... 299/13, 299/10, 12; 166/50, 52, 245
See application file for complete search history.

(56) References Cited

U.S. PATENT DOCUMENTS 6,121,882 A * 9/2000 Jaul et al. ..... 340/584

OTHER PUBLICATIONS

Code of Practice Elevated Temperature and Reactive Ground Version 1.1 Mar. 2007 Australian Explosives Industry and Safety Group Inc.*

* cited by examiner

*Primary Examiner* — John Kreck
(74) *Attorney, Agent, or Firm* — Hueschen and Sage

(57) ABSTRACT

An open cast mining method includes sinking a blasting borehole (14) for receiving an explosive charge into a ground body (12) which is to be mined, taking an initial measurement of one or more borehole conditions, including at least a temperature inside a bottom half (14.1) of the borehole (14), and loading the borehole (14) with a base explosive charge (28) only if the initial measurement of all of the one or more measured borehole conditions are within predefined limits indicating that the borehole (14) will not be subject to uncontrolled detonation of the base explosive charge (28). The one or more borehole conditions, including at least said temperature, are further measured and monitored after the base explosive charge (28) has been loaded. An alarm signal external of the borehole (14) is provided if any of the one or more measured borehole conditions are not within predefined limits so that there is a risk of uncontrolled detonation of the explosive charge (28).

13 Claims, 2 Drawing Sheets

MINING METHOD

THIS INVENTION relates to open cast mining. More particularly, the invention relates to an open cast mining method.

BACKGROUND OF THE INVENTION

Open cast mining typically involves sinking blasting boreholes into an ore-carrying ground body which is to be mined and inserting controlled detonation explosive charges into these boreholes. The explosive charges are then detonated, thereby to loosen the ground to facilitate the conducting of open cast mining by way of surface excavation. In open cast coal mining there is a risk that spontaneous combustion of unmined coal deposits in the vicinity of a borehole can occur under suitable conditions. Such spontaneous combustion of the coal may cause a change in borehole conditions which may lead to premature and uncontrolled detonation of an explosive charge inside a borehole. Such an occurrence presents a serious safety concern to borehole sinking and explosive charge loading operations, as a loaded explosive charge may detonate whilst other boreholes are being loaded. The Applicant believes that this invention will find particular application in addressing this concern

BRIEF SUMMARY OF THE INVENTION

In accordance with the invention, there is provided an open cast mining method which includes sinking a blasting borehole for receiving an explosive charge into a ground body which is to be mined;

taking an initial measurement of one or more borehole conditions, including at least a temperature inside a bottom half of the borehole;

loading the borehole with a base explosive charge only if the initial measurement of all of the one or more measured borehole conditions are within predefined limits indicating that the borehole will not be subject to uncontrolled detonation of the base explosive charge;

continuing to measure one or more borehole conditions, including at least said temperature, after the base explosive charge has been loaded and monitoring the measurements; and providing en alarm signal external of the borehole if any of the one or more measured borehole conditions are not within predefined limits so that there is a risk of uncontrolled detonation of the explosive charge.

The ground body may be a coal-carrying ground body. The base explosive charge is typically a secondary explosive, e.g. TNT, or even more typically a tertiary explosive, e.g. an ammonium nitrate/fuel oil composition. Very often the base explosive is a pumpable tertiary explosive, such as an emulsion, ANFO or both ANFO and an emulsion.

Typically, the one or more borehole conditions are measured with at least one sensor, including at least one temperature sensor, lowered into the borehole. Preferably, however, the method includes using a sensor for each borehole condition being measured.

Measuring and monitoring the one or more borehole conditions thus continue after the borehole is loaded with the base explosive charge. Thus, the at least one sensor is typically provided inside the borehole when the borehole is loaded with the base explosive charge. It will be appreciated that the sensor may also be provided and operating in the borehole before the borehole is loaded with the base explosive, the base explosive thus being loaded into the borehole whilst the sensor is provided and operating in the borehole. Typically, the at least one sensor is loaded into the borehole together with a detonator and/or a booster and is connected, e.g. mounted or clamped, thereto.

Monitoring the measurements of the one or more borehole conditions is typically effected by means of a monitor which is in communication with the at least one sensor and which registers a condition measurement measured by the sensor. The monitor may have an operative position remote from the sensor and may thus be in remote communication therewith. In one embodiment of the invention, the monitor is positioned outside the borehole and is connected to the sensor by means of a sensor connector, such as a conductive wire, along which a sensor condition measurement signal is transmittable to the monitor. Alternatively, the monitor may be integrated with the sensor, thus being loaded into the borehole with the sensor.

The monitor may be in the form of an electronic circuit and may incorporate a microprocessor. In such an embodiment, the monitor may be provided with or connected to a power source, such as a battery or electrochemical cell.

The sensor may also be provided with or connected to a power source, such as a battery or electrochemical cell.

Measuring and/or monitoring the one or more borehole conditions may be done continuously. Alternatively, the measuring and/or monitoring of the borehole condition may be done intermittently, i.e. at set condition measuring and/or condition monitoring intervals. If measuring and/or monitoring the borehole condition is done intermittently, and if a microprocessor is incorporated into the monitoring means, software may be programmed onto the microprocessor, which software controls intermittent measuring and/or monitoring of the borehole condition. More particularly, the sensor and/or monitor may be temporarily activated respectively to take and to register a reading and may then be deactivated until the next reading. Advantageously, using intermittent measuring extends the life of the sensor and/or monitor power sources.

It will be appreciated that, if measuring and monitoring the one or more borehole conditions are both done intermittently, condition measuring intervals and condition monitoring intervals will normally be the same, the borehole condition thus being monitored whilst being measured.

The monitor may be in communication with an alarm. The alarm may be activated by the monitor when a registered measurement of one or more of the measured borehole conditions exceeds the predefined limits for a particular measured borehole condition. The monitor may activate the alarm by any one or more of mechanical, optical, electrical or radio frequency transmission when the predefined limits are exceeded.

The monitor and alarm may be configured also to be activated if the sensor encounters a fault, e.g. if the sensor short-circuits due to melting of sensor-wire insulation.

The alarm may provide the alarm signal by audible or visual transmission when activated.

The monitor may be protected from tampering with and adjustment of the predefined condition limits. Typically, the monitor is encased in a housing, the housing being filled with a molded epoxy resin, thereby to protect the monitor from damage and tampering.

The monitor housing may also be waterproofed to prevent damage, e.g. water damage, during use.

The mining method may include simultaneously measuring and monitoring a borehole condition in a plurality of boreholes, each loaded with a base explosive charge. In such a case, each borehole may be provided with a respective sensor for measuring at least one borehole condition and an associated monitor in communication with the sensor, as hereinbefore described. The monitors may intercommunicate in a mesh network topology by way of radio frequency transmission and may also be in communication, jointly and/or severally, with a master monitoring system, with assistance of high-gain antennas, in such an embodiment, the alarm may be provided at the master monitoring system.

The method may include removing the monitor from its operative position, prior to controlled detonation of the explosive change.

The method may include treating the borehole when the initial condition measurement of one or more of the borehole, conditions is outside its predefined limits, thereby to bring the condition to within its predefined limits, before loading or further loading the borehole with the base explosive charge. When the measured condition is temperature, the method typically includes quenching the borehole with a cooling agent, thereby to reduce the temperature to within the predefined temperature limits.

The predefined limits of the one or more borehole conditions may typically be set to include a buffer such that, when the alarm is activated, uncontrolled detonation of the explosive charge is not imminent and unavoidable, but rather impending, thereby providing time for reaction to the alarm.

Reaction to activation of the alarm typically involves evacuation of persons and/or equipment, which are in positions in which they are in danger of being harmed or damaged by uncontrolled detonation of the explosive charge, to one or more positions of safety away from the borehole.

BRIEF DESCRIPTION OF THE DRAWINGS

The invention will now be described in more detail, with reference to the following diagrammatic drawings in which.

DETAILED DESCRIPTION OF THE INVENTION

Figure 1:
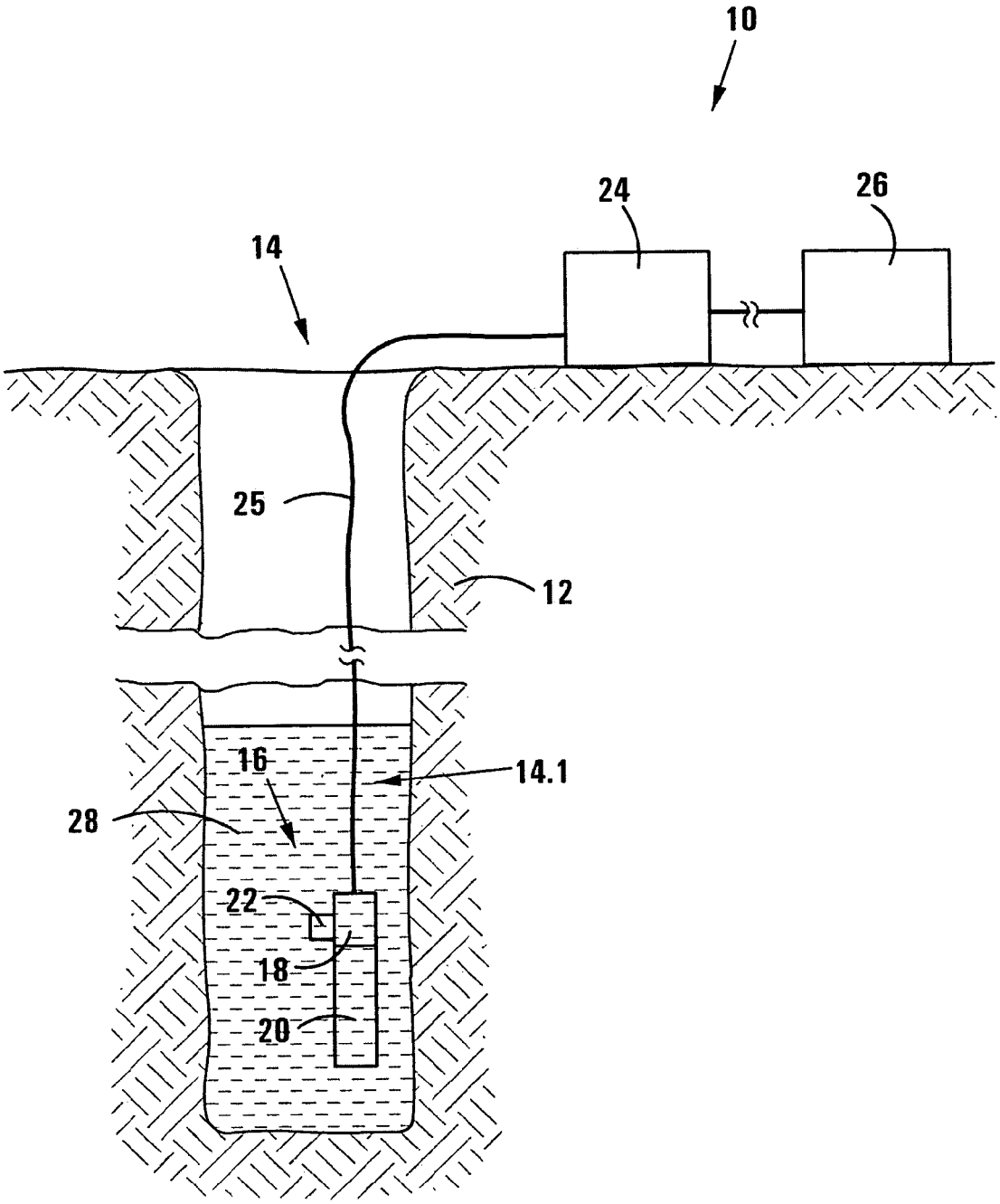
FIG. 1 shows an open-cast mining method or operation, carried out in accordance with the invention.

Referring to the FIG. 1 of the drawings reference numeral 10 generally indicates an open cast mining operation in accordance with the method of the invention.

A blasting borehole 14 has been sunk into an ore-carrying ground body 12. The blasting borehole 14 typically is one of a plurality of such boreholes drilled in accordance with a blasting plan. After an initial measurement of a temperature condition inside a bottom half 14.1 of the borehole 14 has been made (e.g. with a temperature sensor lowered into the borehole 14), the initial temperature measurement being within pre-defined temperature limits, a detonator and booster module 16 is lowered into the bottom half 14.1 of the borehole 14. The module 16 comprises a blasting detonator 18 and a booster 20 connected to the blasting detonator 18.

A temperature sensor 22 is connected to the blasting detonator 18. The sensor 22 measures the temperature inside the bottom half 14.1 of the borehole 14.

The sensor 22 is in fixed-line communication with a monitor 24 which is provided outside the borehole 14. The monitor 24 and the sensor 22 are thus connected by means of a conductive wire 25 along which a temperature measurement signal is transmitted from the sensor 22 to the monitor 24.

The monitor 24 comprises a battery-powered electronic circuit (not shown), which registers and monitors temperature measurements transmitted to it from the sensor 22. If desired, additional borehole conditions, such as pressure, may also be measured and transmitted. A microprocessor (not shown) is incorporated into the circuit, the microprocessor being programmed with software which controls operation of the monitor 24 and the sensor 22. More particularly, the microprocessor software controls intermittent activation and deactivation of the sensor 22 and the monitor 24, the sensor 22 and monitor 24 being activated at predefined temperature measurement and registration intervals to measure and register the borehole temperature and being deactivated after measurement and registration of the temperature until the next reading is taken at the end of the following interval. The temperature measurement intervals and temperature registration intervals are the same.

The monitor 24 is in communication with an alarm 26 which provides an alarm signal once it is activated by the monitor 24, if the monitor 24 registers a temperature measurement which falls outside the predefined temperature limits. Although not illustrated in this embodiment, the alarm 26 is typically mounted onto the monitor 24 and the monitor 24 is in fixed-line communication with the alarm 26. Naturally, the alarm and monitor may also be integrated.

The monitor 24 is encased in a housing which is filled with a molded epoxy resin and is waterproofed, thereby being rendered weather-proof and tamper-proof.

Thus, after the initial air temperature inside the bottom half 14.1 of the borehole 14 has been measured, the booster module 16, having the temperature sensor 22 connected to the blasting detonator 18, is lowered into the bottom half 14.1 of the borehole 14, as hereinbefore described. Further temperature measurements, in addition to the initial temperature measurement, are then taken in intermittent fashion, as hereinbefore described, by intermittent activation and deactivation of the sensor 22 and the monitor 24. After a suitable interval, if the measured temperatures are within predefined limits, i.e. below a predefined maximum temperature and are not showing signs of increasing at an alarming rate, a base explosive 28, e.g. ANFO, an emulsion or both ANFO and an emulsion, is pumped into the borehole 14. Temperature measurements then continue in intermittent fashion, before controlled detonation of the module 16 and the explosive 28, typically in accordance with a blasting plan. Prior to controlled detonation of the module 16 and the explosive 23, and provided that alarm 26 has not been activated, the monitor 24 is disconnected from the sensor 22 and removed from its operative position to be re-used. Advantageously, when an electronic detonator 18 is used, it can be detonated using the wire 25 for communication purposes.

If the alarm 26 is activated, persons and/or equipment, which are in positions in which they are in danger of being harmed or damaged by uncontrolled detonation of the explosive 28, are evacuated to a safe location away from the borehole 14. If still safe to approach the borehole, the borehole may also be quenched with a cooling agent, e.g. water, to prevent uncontrolled detonation.

Figure 2:
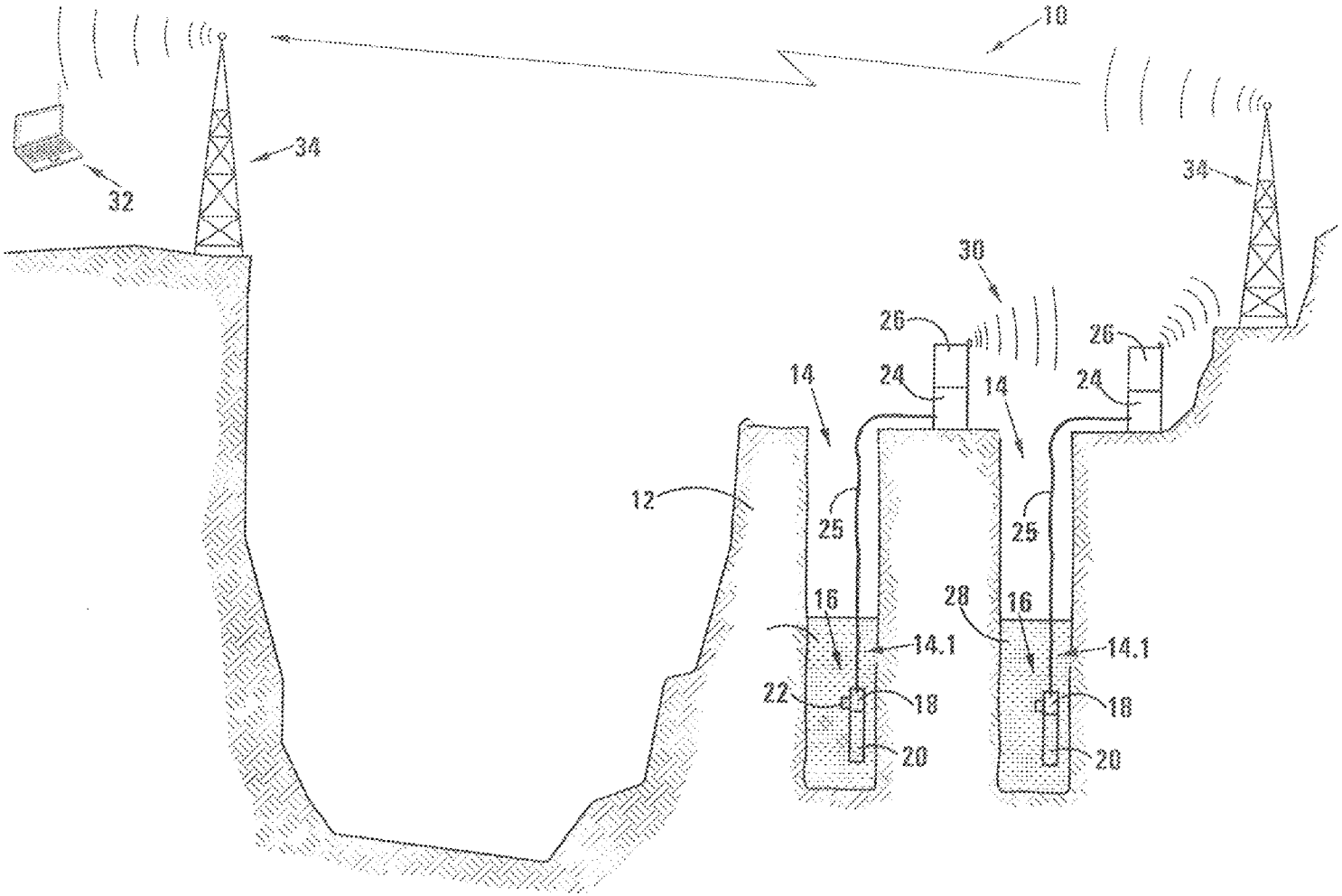
FIG. 2 shows an open-cast mining method or operation, carried out in accordance with the invention.

As shown in FIG. 2 of the drawings, the mining method 10 may include simultaneously measuring and monitoring a borehole condition in a plurality of boreholes 14, each loaded with a base explosive charge 28. In such a case, each borehole 14 may be provided with a respective sensor 22 for measuring at least one borehole condition and an associated monitor 24 in communication with the sensor 22. In one embodiment of the invention, the monitors 24 intercommunicate in a mesh network topology, e.g. by way of radio frequency transmission and may also be in communication, jointly and/or severally, with a master monitoring system 32, with assistance of high-gain antennas 34. In such an embodiment, an alarm may be provided at the master monitoring system 32.

It is regarded as an advantage of the invention as described that the continued measuring and monitoring of the borehole temperature, and other borehole conditions, such as pressure, if applicable, in addition to the initial air temperature measurement, provides a continued indication of the safety condition of a loaded borehole. An early warning of impending uncontrolled detonation is thus provided by the invention, which early warning provides opportunity for reaction to such impending uncontrolled detonation and thus contributes to the safety of open-cast mining operations.

The invention claimed is:

1. An open cast mining method which includes sinking a blasting borehole for receiving an explosive charge into a ground body which is to be mined;

taking an initial measurement of one or more borehole conditions, including at least a temperature inside a bottom half of the borehole;

loading the borehole with a base explosive charge only if the initial measurement of all of the one or more measured borehole conditions are within predefined limits indicating that the borehole will not be subject to uncontrolled detonation of the base explosive charge;

continuing to measure one or more borehole conditions, including at least said temperature, after the base explosive charge has been loaded and monitoring the measurements; and providing an alarm signal external of the borehole if any of the one or more measured borehole conditions are not within predefined limits so that there is a risk of uncontrolled detonation of the explosive charge.

2. The mining method as claimed in claim 1, in which the ground body is a coal-carrying ground body.

3. The mining method as claimed in claim 1, in which one or more borehole conditions are measured with at least one sensor, including at least one temperature sensor, lowered into the borehole.

4. The mining method as claimed in claim 3, in which the at least one sensor is loaded into the borehole together with a detonator and/or a booster.

5. The mining method as claimed in claim 3, in which monitoring the measurements of the one or more borehole conditions is effected by means of a monitor which is in communication with the at least one sensor and which registers a condition measurement measured by the sensor.

6. The mining method as claimed in claim 5, in which the monitor is positioned outside the borehole and is connected to the sensor by means of a sensor connector along which a sensor condition measurement signal is transmittable to the monitor.

7. The mining method as claimed in claim 1, in which the measuring and/or monitoring of the borehole condition is done intermittently, i.e. at set condition measuring and/or condition monitoring intervals.

8. The mining method as claimed in claim 1, which includes simultaneously measuring and monitoring a borehole condition in a plurality of boreholes, each loaded with a base explosive charge.

9. The mining method as claimed in claim 8, in which each borehole is provided with a respective sensor for measuring at least one borehole condition and an associated monitor in communication with the sensor.

10. The mining method as claimed in claim 9, in which the monitors intercommunicate in a mesh network topology by way of radio frequency transmission and are also in communication, jointly and/or severally, with a master monitoring system.

11. The method as claimed in claim 5, which includes removing the monitor from its operative position, prior to controlled detonation of the explosive charge.

12. The method as claimed in claim 9, which includes removing the monitors from their operative position, prior to controlled detonation of the explosive charges.

13. The method as claimed in claim 1, which includes treating the borehole the initial condition measurement of one or more of the borehole conditions is outside its predefined limits, thereby to bring the condition to within its predefined limits, before loading or further loading the borehole with the base explosive charge.

* * * * *

UNITED STATES PATENT AND TRADEMARK OFFICE

CERTIFICATE OF CORRECTION

PATENT NO. : 8,342,609 B2
APPLICATION NO. : 12/660812
DATED : January 1, 2013
INVENTOR(S) : Robert James Holdcroft et al.

It is certified that error appears in the above-identified patent and that said Letters Patent is hereby corrected as shown below:

Column 6, Line 34: "treating the borehole the initial" should be
--treating the borehole when the initial--.

Signed and Sealed this
Twelfth Day of February, 2013

Teresa Stanek Rea
*Acting Director of the United States Patent and Trademark Office*